US011919679B2

(12) United States Patent
Turner

(10) Patent No.: US 11,919,679 B2
(45) Date of Patent: Mar. 5, 2024

(54) STRAP CONTAINER SYSTEM AND METHOD

(71) Applicant: RUGGED SAFETY, LLC, Bellevue, OH (US)

(72) Inventor: Thomas J. Turner, Bellevue, OH (US)

(73) Assignee: RUGGED SAFETY, LLC, Bellevue, OH (US)

( * ) Notice: Subject to any disclaimer, the term of this patent is extended or adjusted under 35 U.S.C. 154(b) by 4 days.

(21) Appl. No.: 17/893,479

(22) Filed: Aug. 23, 2022

(65) Prior Publication Data

US 2023/0053762 A1 Feb. 23, 2023

Related U.S. Application Data

(60) Provisional application No. 63/235,969, filed on Aug. 23, 2021.

(51) Int. Cl.
*B65D 25/20* (2006.01)
*B65D 25/54* (2006.01)
*B65D 43/16* (2006.01)

(52) U.S. Cl.
CPC ..... *B65D 25/20* (2013.01); *B65D 25/54* (2013.01); *B65D 43/167* (2013.01)

(58) Field of Classification Search
CPC ..... B65D 25/20; B65D 25/54; B65D 43/167
USPC ..... 220/694, 751, 754
See application file for complete search history.

(56) References Cited

U.S. PATENT DOCUMENTS

| | | | | |
|---|---|---|---|---|
| 5,839,932 | A * | 11/1998 | Pierce | B63C 9/1255 441/84 |
| 8,261,925 | B2 * | 9/2012 | Murphy | B65D 21/0204 220/23.4 |
| D811,219 | S | 2/2018 | Turner | |
| D811,873 | S | 3/2018 | Turner | |
| 11,565,850 | B1 * | 1/2023 | Lovell | F16M 13/02 |
| 2002/0079313 | A1 * | 6/2002 | Grayson | A01K 97/06 43/57.1 |
| 2009/0127146 | A1 * | 5/2009 | Krebs | B25H 3/04 206/478 |
| 2014/0014541 | A1 * | 1/2014 | Junk | F41C 33/06 206/317 |
| 2019/0092528 | A1 * | 3/2019 | Slattery | B65D 81/3813 |
| 2020/0039689 | A1 * | 2/2020 | Leinbach | B65D 43/02 |

FOREIGN PATENT DOCUMENTS

| | | | | |
|---|---|---|---|---|
| DE | 202007015436 U1 * | 3/2008 | | A01K 1/0356 |
| WO | WO-2018186841 A1 * | 10/2018 | | F16M 13/02 |

* cited by examiner

*Primary Examiner* — J. Gregory Pickett
*Assistant Examiner* — Niki M Eloshway
(74) *Attorney, Agent, or Firm* — Jacob M. Ward; Ward law Office LLC

(57) ABSTRACT

A storage container may include a hollow main body, a lid, and an attachment mechanism for removably attaching a shackle holder. The hollow main body has a plurality of sidewalls, a first end, and a second end, opposite the first end. The lid may be disposed on the first end of the main body and the attachment mechanism may be disposed on the second end of the hollow main body. The shackle holder may be configured to retain a shackle. The shackle holder is capable of being disposed on storage containers with main bodies that vary in size.

20 Claims, 8 Drawing Sheets

STRAP CONTAINER SYSTEM AND METHOD

CROSS-REFERENCE TO RELATED APPLICATIONS

This application claims the benefit of U.S. Provisional Application No. 63/235,969 filed on Aug. 23, 2021. The entire disclosure of the above application is incorporated herein by reference.

FIELD

Field

The present disclosure relates to containers and, more particularly, to utility storage boxes.

Background

The statements in this section merely provide background information related to the present disclosure and may not constitute prior art.

Straps are commonly used in industries such as construction, transportation, towing, lifting, military, and search and rescue for a variety of purposes. However, across these industries, the straps are commonly exposed to a variety of elements that may compromise the structural integrity and performance of the strap. For example, these straps may be constructed from nylon material which are frequently found to be frayed, cut, singed, and twisted due to the storage conditions of the straps.

There are requirements for these straps to be maintained in a condition which allows them to function according to their specifications as set forth by OSHA (Occupational Safety and Health Administration), ASME B30.9 (American Society of Mechanical Engineers) and WSTDA (Web Sling and Tie Down Association). Failure of maintaining the functioning condition of these straps may lead to costly damages and inadequate performance.

The straps may be damaged due to improper storage while the strap is not in use. Straps may be left on workshop floors or hung on a wall within proximity to sparks and debris from a workshop area. In addition, the straps may become unwound and damaged as they are stored and transported without a proper case and protection. Moreover, without a proper container, the straps may be lost or misplaced as they are improperly removed from or left at a job site.

Accordingly, there is a continuing need for a storage container that has the strength to protect these straps while also be portable enough to promote their use at the jobsite.

SUMMARY

In concordance with the instant disclosure, a storage container that has the strength to protect straps while also being portable enough to promote their use at the jobsite, has surprisingly been discovered.

In certain embodiments, a storage container includes a hollow main body for receiving a strap. The hollow main body may have a plurality of sidewalls, a first end, and a second end. The first end may be on an opposite side of the hollow main body from the second end. The first end of the hollow main body may further include a lid. An attachment mechanism configured to removably hold a shackle holder may be disposed on an outside surface of a second end of the hollow main body. The attachment mechanism may comprise a protrusion extending outwardly from the second end of the main body.

The shackle holder may slidably attach to the protrusion. For example, the shackle holder may be removably disposed on the hollow main body with the protrusion and a corresponding notch of the shackle holder. In certain embodiments, the protrusion and the notch may slidably attach through a sliding dovetail connection. However, as would be understood by someone of ordinary skill in the art, the shackle holder may removably attach to the storage container by any attachment mechanism as appropriately desired. In certain embodiments, the shackle holder may be permanently affixed to the storage container.

The shackle holder may be removably and/or permanently disposed on the second end of the hollow main body. The hollow main body may vary in size to accommodate differently sized straps. In certain embodiments, the hollow main body may be configured to hold a plurality of straps. The shackle holder may be configured to be disposed on each of the variable sized hollow main bodies. For example, the shackle holder may be removed from a first hollow main body and removably attach to a second differently sized hollow main body of a storage container.

In certain embodiments, a storage container for a strap includes a hollow main body. The hollow main body may include a first end and a second end, where the second end of the hollow main body is opposite the first end. A lid may be disposed at the first end of the body and an attachment mechanism may be disposed at the second end of the hollow main body. The attachment mechanism may be configured to removably attach a shackle holder to the hollow main body. The attachment mechanism may comprise a protrusion extending outwardly from the second end for removably attaching the shackle holder to the hollow main body. In certain embodiments, the shackle holder may slidably attach to the protrusion. For example, the protrusion may comprise a sliding dovetail connection such that the shackle holder slidably attaches to the second end of the hollow main body through the sliding dovetail connection.

The lid may comprise a hinged lid that attaches to the hollow main body through a hinge, where the lid is tilted via the hinge to access the hollow main body. The hinged lid may include a retaining mechanism. In certain embodiments, the retaining mechanism may include one of a friction fit, a clasp, a lock, a male/female attachment, a rubberized T-latch, and combinations thereof. In certain embodiments, the hinged lid comprises a pin and knuckle joint for tilting the lid. The lid may include a window for viewing an interior of the hollow main body. In certain embodiments, the hollow main body may be configured to hold a plurality of straps.

In certain embodiments a kit for protecting a strap includes a storage container for the strap, a shackle holder removably attached to the storage container, a shackle retained on the shackle holder, and a strap disposed within the storage container. The storage container may include a hollow main body including a first end and a second end, where the second end of the hollow main body is opposite the first end. A lid may be disposed at the first end of the main body.

The shackle holder may include a shackle holder body comprising a main body side and a shackle side. The main body side may be configured to removably attach to the outside surface of the second end of the hollow main body and the shackle side may be configured to engage the shackle. The shackle holder may further include a shackle mouth and an aperture to retain the shackle bow and the shackle pin. The lid may comprise a hinged lid that attaches to the hollow main body through a hinge, where the lid is tilted via the hinge to access the main body. The lid may include a window for viewing an interior of the hollow main body. In certain embodiments, the hollow main body may be configured to hold a plurality of straps.

In certain embodiments, a method of storing a strap includes opening a lid to access a hollow main body of a storage container for storing the strap, disposing the strap within the hollow main body, closing the lid, removably attaching a shackle holder to an attachment mechanism of the hollow main body, and securing a shackle on the shackle holder. In certain embodiments, the lid may disposed at a first end of the hollow main body, and the attachment mechanism may be disposed at a second end of the main body. Opening the lid may comprise tilting the lid via a hinge to access the main body. Removably attaching the shackle holder to the attachment mechanism may comprise slidably attaching the shackle holder to a sliding dovetail connection. In certain embodiments, the shackle holder may be removed from the attachment mechanism of the hollow main body and removably attached to a second, differently sized storage container.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
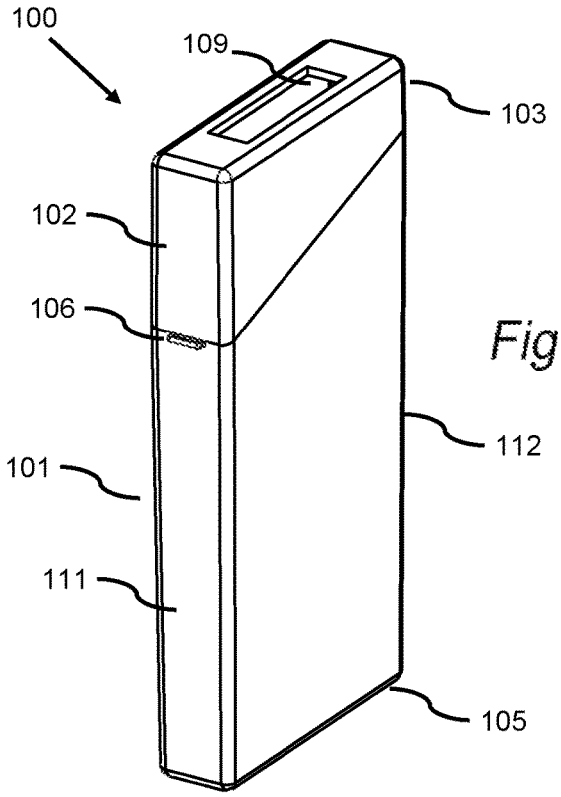
FIG. 1 shows a front perspective view of a first embodiment of a storage container, depicting the device in an assembled closed position in accordance with the present technology.
Figure 2:
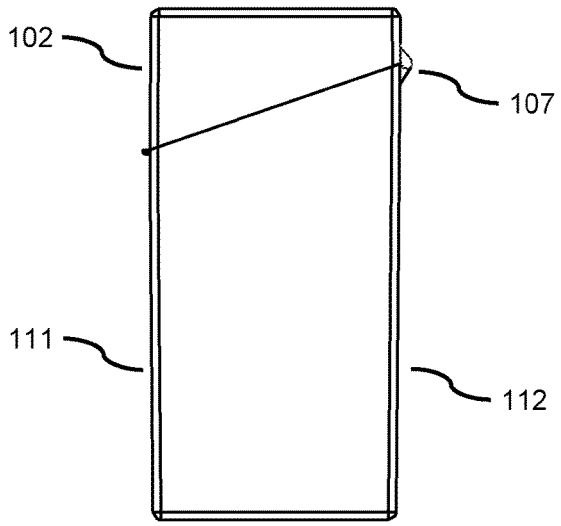
FIGS. 2 and 3 show side elevational views of the first embodiment of the storage container, depicting the device in an assembled closed position.
Figure 3:
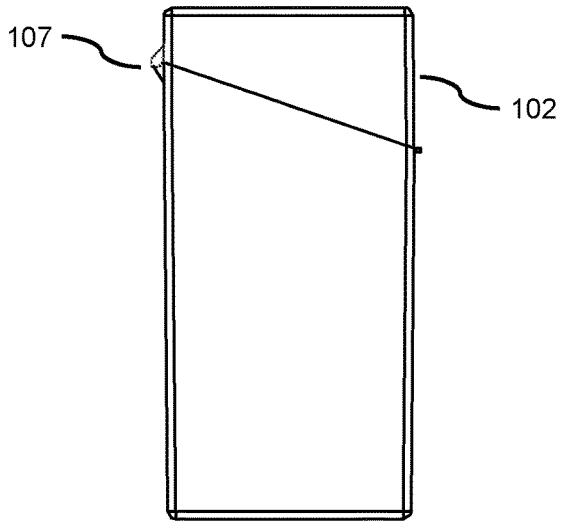
Figure 4:
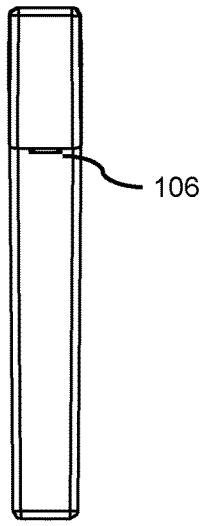
FIG. 4 shows a front elevational view of the first embodiment of the storage container, depicting the device in an assembled closed position.
Figure 5:
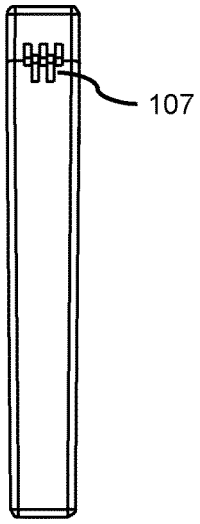
FIG. 5 shows a rear elevational view of the first embodiment of the storage container, depicting the device in an assembled closed position.
Figure 6:
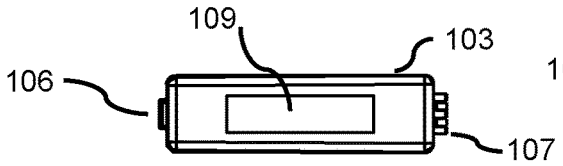
FIG. 6 shows a top plan view of the first embodiment of the storage container, depicting the device in an assembled closed position.
Figure 7:
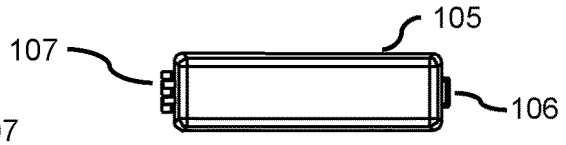
FIG. 7 shows a bottom plan view of the first embodiment of the storage container, depicting the device in an assembled closed position.
Figure 8:
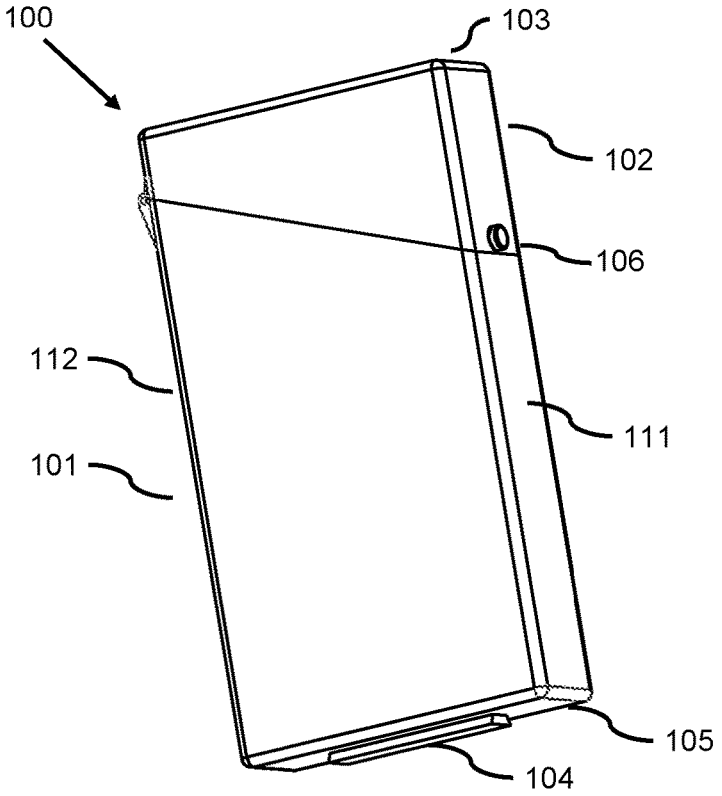
FIGS. 8 and 9 show a front perspective view of a second embodiment of a storage container, depicting the device in an assembled closed position, in accordance with the present technology.
Figure 9:
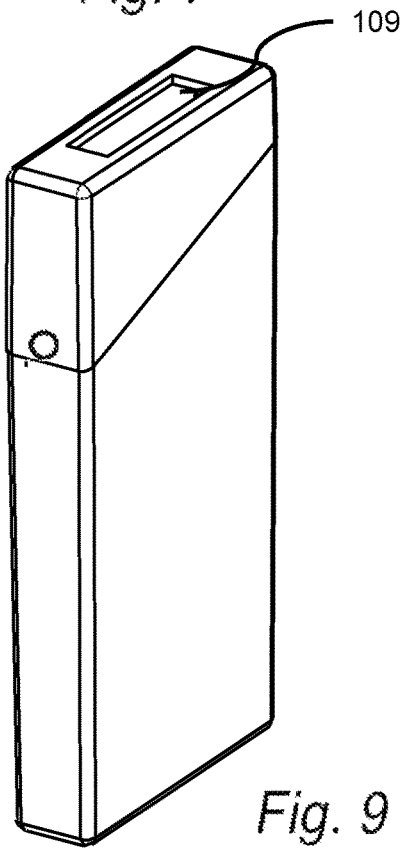
Figure 10:
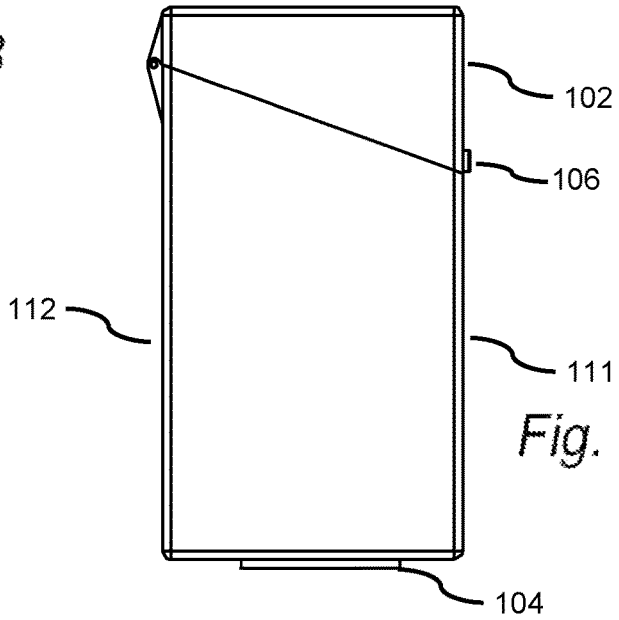
FIGS. 10 and 11 show side elevational views of the second embodiment of the storage container, depicting the device in an assembled closed position.
Figure 11:
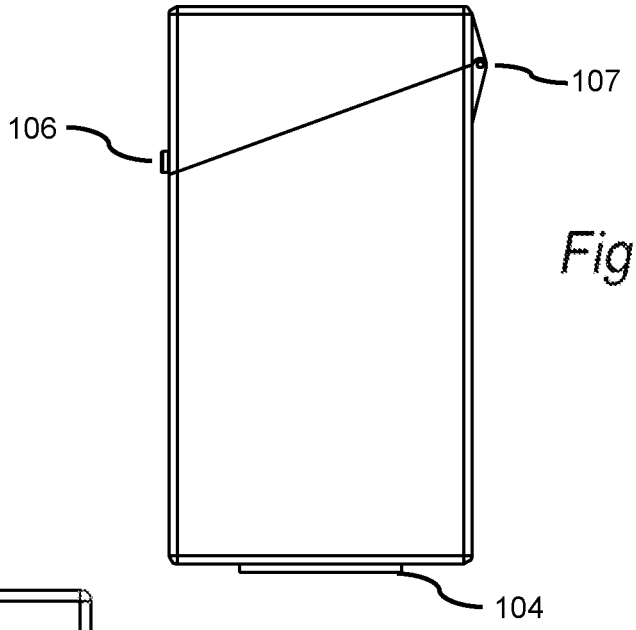
Figure 12:
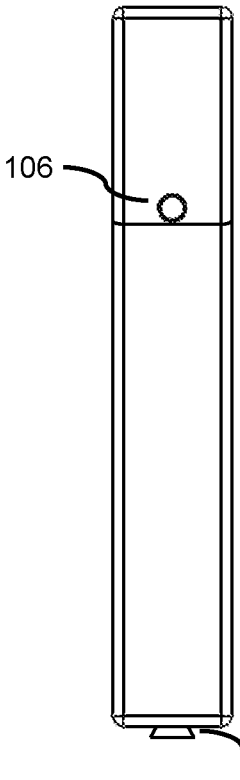
FIG. 12 shows a front elevational view of the second embodiment of the storage container, depicting the device in an assembled closed position.
Figure 13:
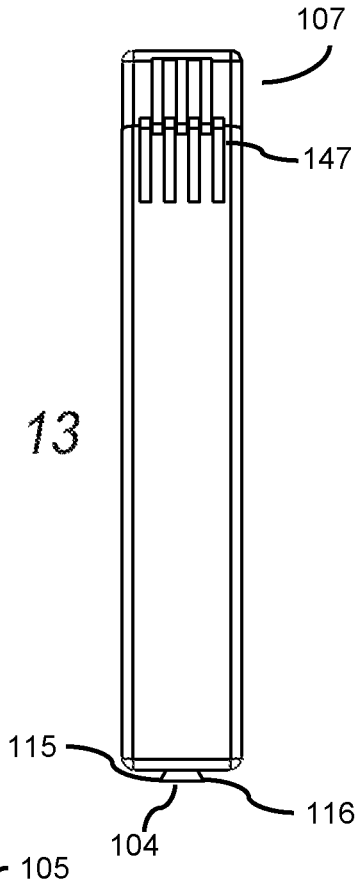
FIG. 13 shows a rear elevational view of the second embodiment of the storage container, depicting the device in an assembled closed position.
Figure 14:
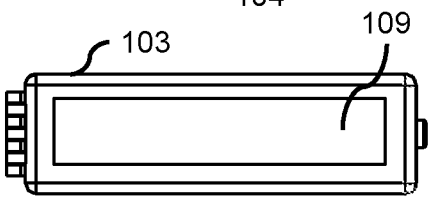
FIG. 14 shows a top plan view of the second embodiment of the storage container, depicting the device in an assembled closed position.
Figure 15:
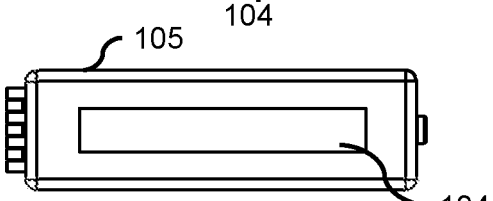
FIG. 15 shows a bottom plan view of the second embodiment of the storage container, depicting the device in an assembled closed position.
Figure 16:
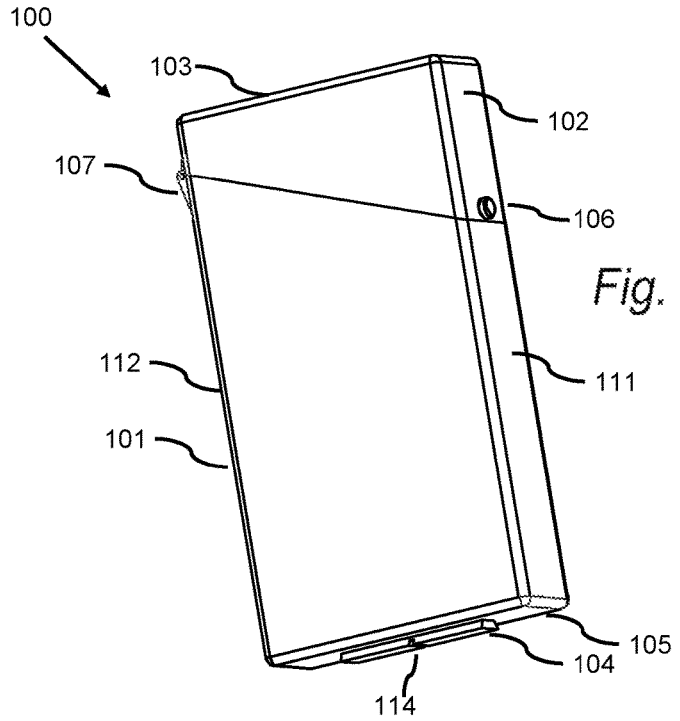
FIG. 16 shows a front perspective view of a third embodiment of a storage container, depicting the device in an assembled closed position in accordance with the present technology.
Figure 17:
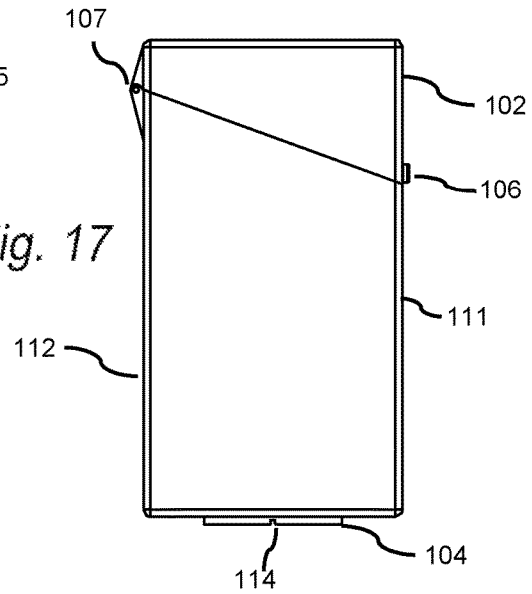
FIGS. 17 and 18 show side elevational views of the third embodiment of the storage container, depicting the device in an assembled closed position.
Figure 18:
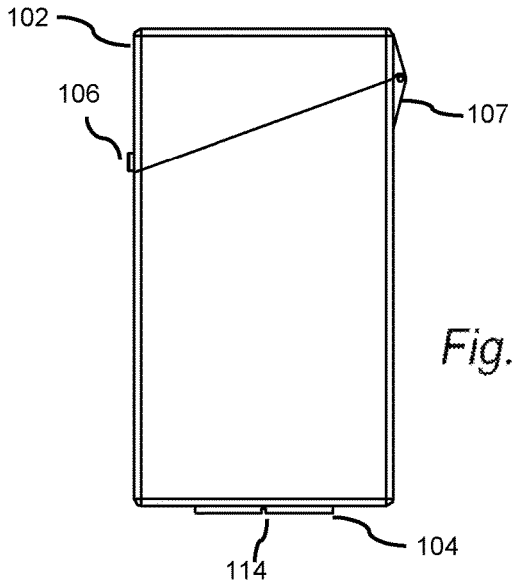
Figure 19:
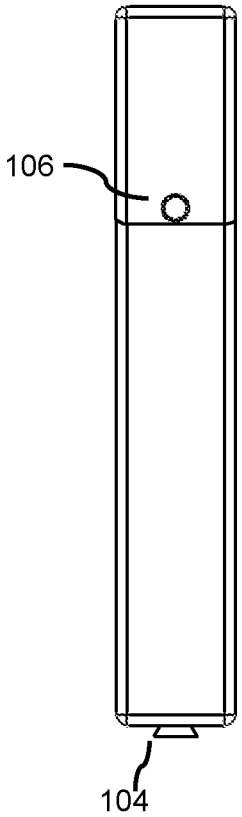
FIG. 19 shows a front elevational view of the third embodiment of the storage container, depicting the device in an assembled closed position.
Figure 20:
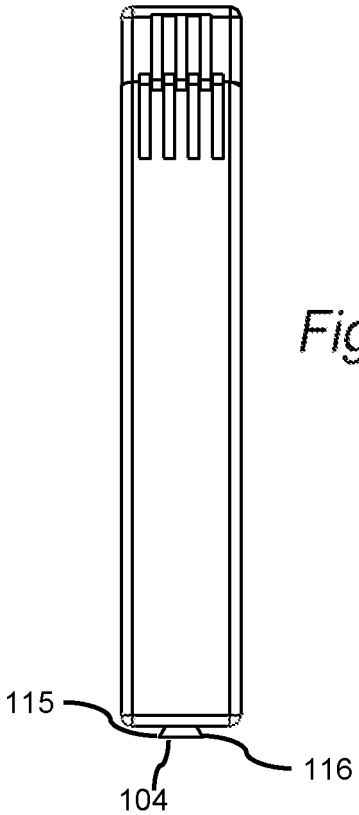
FIG. 20 shows a rear elevational view of the third embodiment of the storage container, depicting the device in an assembled closed position.
Figure 21:
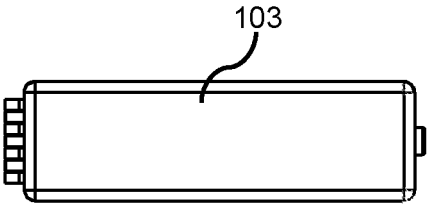
FIG. 21 shows a top plan view of the third embodiment of the storage container, depicting the device in an assembled closed position.
Figure 22:
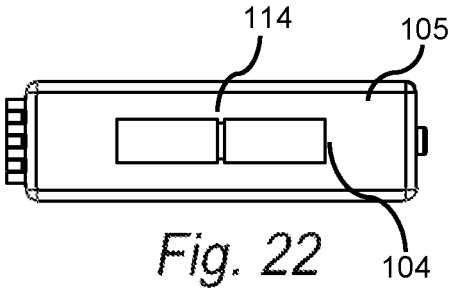
FIG. 22 shows a bottom plan view of the third embodiment of the storage container, depicting the device in an assembled closed position.

The following description of technology is merely exemplary in nature of the subject matter, manufacture, and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9,1-8,1-3,1-2,2-10, 2-8,2-3,3-10,3-9, and so on.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology relates to a storage container which includes a hollow main body for receiving a strap. The hollow main body may have a plurality of sidewalls, a first end, and a second end. The first end may be on an opposite side of the hollow main body from the second end. The first end of the hollow main body may further include a lid. The lid may include a hinge mechanism for tilting the lid to an open position. Alternatively, the lid may be slidably removable from the second end of the hollow main body. An attachment mechanism configured to removably hold a shackle holder may be disposed on an outside surface of a second end of the hollow main body. The attachment mechanism may comprise a protrusion extending outwardly from the second end of the main body.

In certain embodiments, the shackle holder may slidably attach to the protrusion. For example, the shackle holder may be removably disposed on the hollow main body with the protrusion and a corresponding notch of the shackle holder. In certain embodiments, the protrusion and the notch may slidably attach through a sliding dovetail connection. However, as would be understood by someone of ordinary skill in the art, the shackle holder may removably attach to the storage container by any attachment mechanism as appropriately desired. In certain embodiments, the shackle holder may be permanently affixed to the storage container.

The hollow main body may vary in size to accommodate differently sized straps. In certain embodiments, the hollow main body may be configured to hold a plurality of straps. The shackle holder may be configured to be disposed on each of the variable sized hollow main bodies. For example, the shackle holder may be removed from a first hollow main body and removably attach to a second differently sized hollow main body of a storage container. In this manner, a single shackle holder may be used with a variety of differently sized and configured storage containers. Advantageously, the storage container stores the straps in a condition that maintains their structural integrity and provides accessibility to the straps in a manner that would promote the use of the storage container at the jobsite.

The lid may have a retaining mechanism to retain the hinged lid in a closed position, where desired. The retaining mechanism may include a friction fit mechanism, a clasp, a lock, a male/female attachment, a rubberized T-latch, and combinations thereof. In certain embodiments, the friction fit mechanism may be further defined as a raised protrusion disposed on the main body that fits snugly within a corresponding recess on an interior surface of the lid. As would be understood by someone of ordinary skill in the art, the retaining mechanism may comprise a retaining mechanism as appropriately desired for securing the lid. Advantageously, the lid allows a user to securely store the straps in a protected manner while also providing a convenient way to remove the straps from the hollow main body.

The shackle holder may include a shackle holder body configured to receive a shackle. The shackle holder body may have a main body side and a shackle side. The main body side of the shackle holder body may include a notch for slidably receiving the protrusion of the main body. The shackle side may have an aperture configured to retain the shackle pin. The shackle side may further have a shackle mouth configured to retain the shackle bow. In operation, the aperture and the shackle mouth may be utilized in conjunction to store the shackle bow and the shackle pin. Advantageously, the shackle holder secures the shackle in a manner that militates against losing the shackle while a corresponding strap is stored within the hollow main body. Desirably, the shackle mouth also militates against the shackle from undesirably moving while the shackle is stored.

In certain embodiments, the lid may have a window. For example, the lid may include a transparent or a translucent window. Advantageously, the transparent or translucent window may provide a user a quick visual reference to see if the storage container is empty. In addition, the transparent or translucent window may allow a user to reference color coded straps more easily.

In certain embodiments, the storage container may be made of durable UV, high-density polyethylene (HDPE), acrylonitrile butadiene styrene (ABS) plastic, and combinations thereof. In particular, the storage container may be manufactured from any appropriately desired durable material. In certain embodiments the storage container may be manufactured using one of injection and blow molding. The storage container may be color coded to correspond with a variety of strap lengths and widths. The hollow main body of the storage container may be further configured to be stackable with additional storage containers. The hollow main body may be textured so that the additional storage containers do not slip when placed in the stackable configuration. In addition, the hollow main body may vary in size to accommodate differently sized straps. For example, the hollow main body may be configured to hold one an eight-foot strap, a ten-foot strap, and a 24-foot strap. However, the hollow main body may be configured to hold any appropriately desired size and width of strap.

Advantageously, the stackable storage containers may provide an easier method of storing the straps and provide a more efficient method of taking inventory of the straps and transporting the straps. The storage container has the strength to protect these straps while also being portable enough to promote use at the jobsite.

EXAMPLES

Example embodiments of the present technology are provided with reference to the several figures enclosed herewith.

Figure 25:
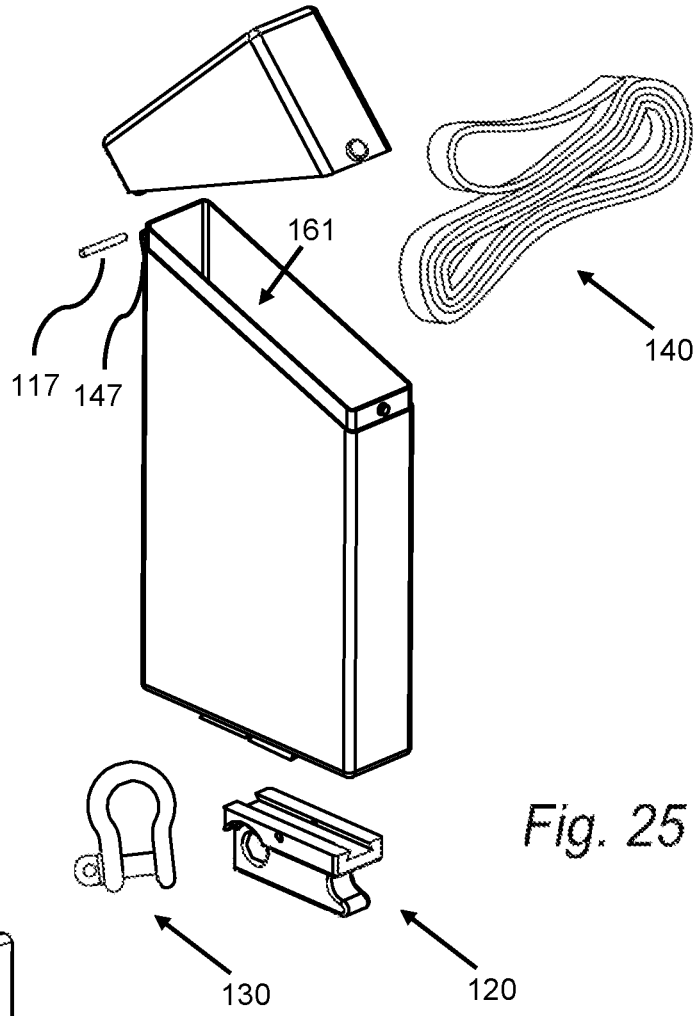
FIG. 25 shows an exploded view of a storage container, showing the components thereof, in accordance with the present technology.

FIGS. 1-7 show a storage container for a strap 100, in accordance with a first embodiment. The storage container for the strap 100 may include a hollow main body 101 for receiving a strap 140 (FIG. 25). The hollow main body 101 may include a first sidewall 111, a second sidewall 112, a first end 103, and a second end 105, opposite the first end 103. The first end 103 of the hollow main body 101 may include a lid 102. The lid 102 may include a hinge 107 for tilting the lid 102 to an open position. Alternatively, the lid 102 may be slidably removable from the second end 105 of the hollow main body 101.

Figure 28:
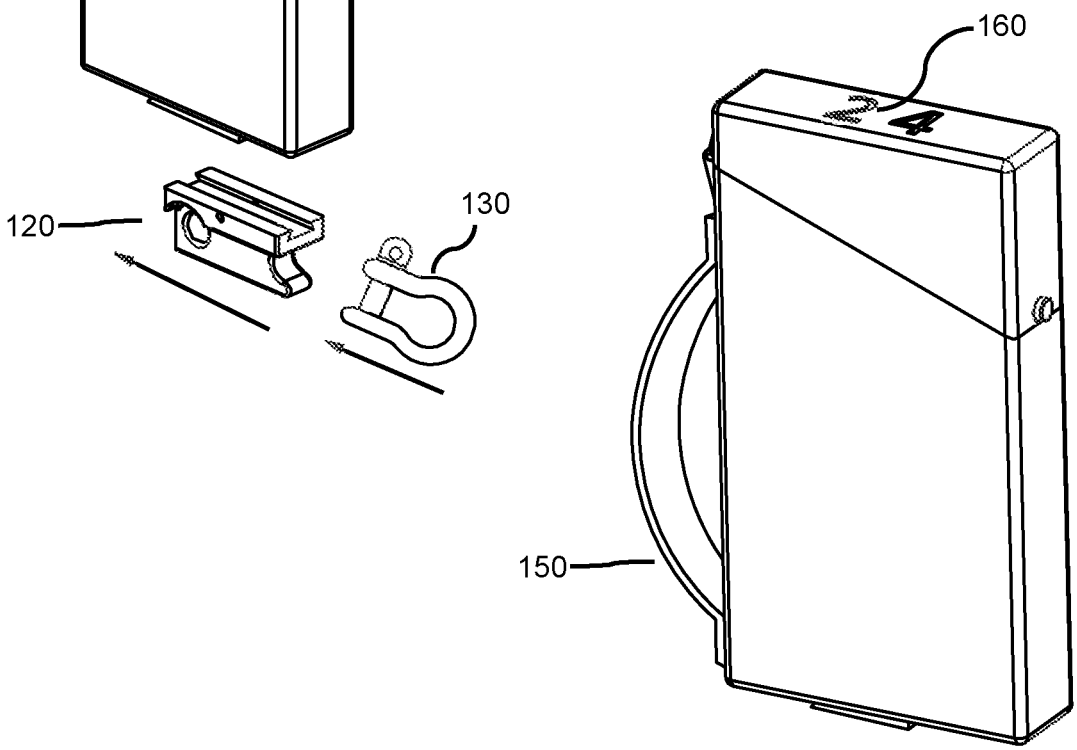
FIG. 28 shows a front perspective view of a storage container, depicting the device in an assembled closed position and showing a handle, in accordance with the present technology.

The lid 102 may further include a retaining mechanism 106 to retain the lid 102 in a closed position, where desired. The retaining mechanism 106 may include a friction fit mechanism, a clasp, a lock, a male/female attachment, a rubberized T-latch, and combinations thereof. In certain embodiments, the friction fit mechanism may be further defined as a raised protrusion disposed on the main body that fits snugly within a corresponding recess on an interior surface of the lid. As would be understood by someone of ordinary skill in the art, the retaining mechanism 106 may comprise a retaining mechanism 106 as appropriately desired for securing the lid 102. In certain embodiments, the lid 102 allows a user to securely store a strap 140 in a protected manner while also providing a convenient way to remove the strap 140 from the hollow main body 101. In certain embodiments, the lid 102 may include a window 109. For example, the lid may include a transparent or a translucent window 109. The window 109 may provide a user a visual reference to see if the storage container is empty. In addition, the window 109 may allow a user to reference a color coded strap more easily 140. In certain embodiments, the storage container for a strap 100 may include a handle 150 (FIG. 28) for manually transporting the storage container for a strap 100.

FIGS. 8-22 show a show a storage container for a strap 100, in accordance with a second and third embodiment. The second and third embodiment of the storage container for the strap 100 may include a hollow main body 101 for receiving a strap 140. The hollow main body 101 may include a first sidewall 111, a second sidewall 112, a first end 103, and a second end 105, opposite the first end 103. The first end 103 of the hollow main body 101 may include a lid 102. The lid 102 may include a hinge 107 mechanism for tilting the lid 102 to an open position. In certain embodiments, the hinge 107 may comprise a pin 117 and knuckle joint 147 (FIG. 25). However, the lid 102 may be tilted to an open position using any mechanism as appropriately desired. Alternatively, the lid 102 may be slidably removable from the second end 105 of the hollow main body 101.

The lid may further include a retaining mechanism 106 to retain the lid 102 in a closed position, where desired. The retaining mechanism 106 may include a friction fit mechanism, a clasp, a lock, a male/female attachment, a rubberized T-latch, and combinations thereof. In certain embodiments, the friction fit mechanism may be further defined as a raised protrusion 137 disposed on the main body that fits snugly within a corresponding recess (FIG. 26) on an interior surface of the lid, such that pushing a button 136 releases the lid 102 to open the lid 102. As would be understood by someone of ordinary skill in the art, the retaining mechanism 106 may comprise a retaining mechanism 106 as appropriately desired for securing the lid 102. In certain embodiments, the lid 102 allows a user to securely store a strap 140 in a protected manner while also providing a convenient way to remove the strap 140 from the hollow main body 101.

As shown in FIGS. 8-15, the storage container for a strap 100, may include an attachment mechanism 104 configured to removably hold a shackle holder 120 (FIG. 23) on an outside surface of the second end 105 of the hollow main body 101. The attachment mechanism 104 may comprise a protrusion extending outwardly from the second end 105 of the main body 101. As shown in FIGS. 8-15, the protrusion may be a continuous protrusion including a first protrusion shoulder 115 and a second protrusion shoulder 116. Alternatively, as shown in FIGS. 16-22, the protrusion may include a channel 114 across a center of the attachment mechanism 104, a first protrusion shoulder 115 and a second protrusion shoulder 116.

In certain embodiments, the shackle holder 120 may slidably attach to the attachment mechanism 104. For example, the shackle holder 120 may be removably disposed on the hollow main body 101 with the attachment mechanism 104 and a corresponding shaped notch 121 of the shackle holder 120. In certain embodiments, the attachment mechanism 104 and the notch 121 may slidably attach through a sliding dovetail connection. For example, the attachment mechanism 104 may include a first protrusion shoulder 115 and a second protrusion shoulder 116, which are configured to slide against the first notch shoulder 125 and the second notch shoulder 126 of the correspondingly shaped notch 121 of the shackle holder 120 when slidably attached with the attachment mechanism 104. However, as would be understood by someone of ordinary skill in the art, the shackle holder 120 may removably attach to the hollow main body 101 by any attachment mechanism as appropriately desired. In certain embodiments, the shackle holder 120 may be permanently affixed to the storage container. In certain embodiments, the storage container for a strap 100 may include a handle 150 for manually transporting the storage container for a strap 100.

Figure 23:
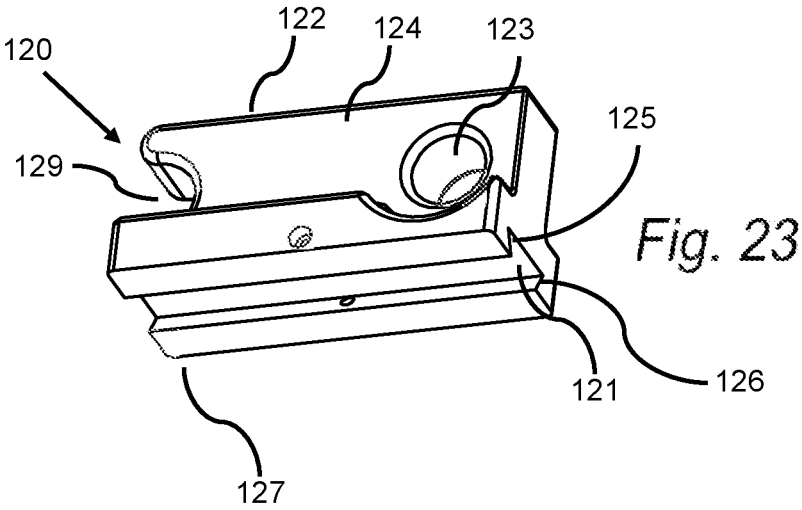
FIG. 23 shows a front perspective view of a shackle holder, in accordance with the present technology.
Figure 24:
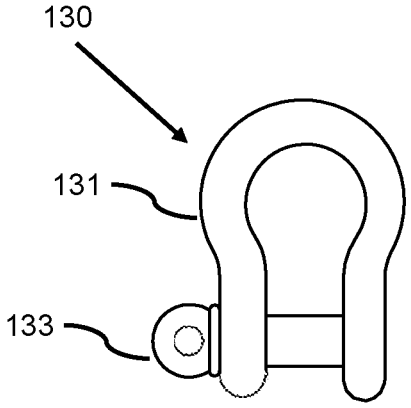
FIG. 24 shows a front perspective view of a shackle holder, in accordance with the present technology.

As shown in FIG. 23, the shackle holder 120 may include a shackle holder body 122 configured to receive a shackle bow 131 and a shackle pin 133 (FIG. 24). The shackle holder body 122 may have a hollow main body side 127 and a shackle side 124. The main body side 127 of the shackle holder body 122 may include a notch 121 for slidably receiving the attachment mechanism 104 of the hollow main body 101. The shackle side 124 may have an aperture 123 configured to retain the shackle pin 133. The shackle side 124 may further have a shackle mouth 129 configured to retain the shackle bow 131. In operation, the aperture 123 and the shackle mouth 129 may be utilized in conjunction to store the shackle bow 131 and the shackle pin 133. Advantageously, the shackle holder 120 secures the shackle 130 in a manner that militates against losing the shackle 130 while a corresponding strap 140 is stored within the hollow main body 101. The shackle mouth 129 may also militate against the shackle bow 131 from undesirably moving while the shackle 130 is stored.

Figure 27:
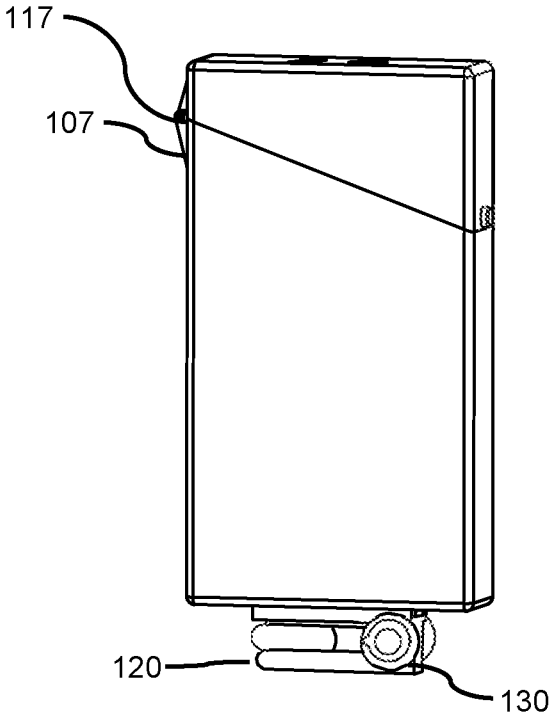
FIG. 27 shows a side elevational view of the storage container with the shackle holder and the shackle attached to the storage container, in accordance with the present technology.
Figure 26:
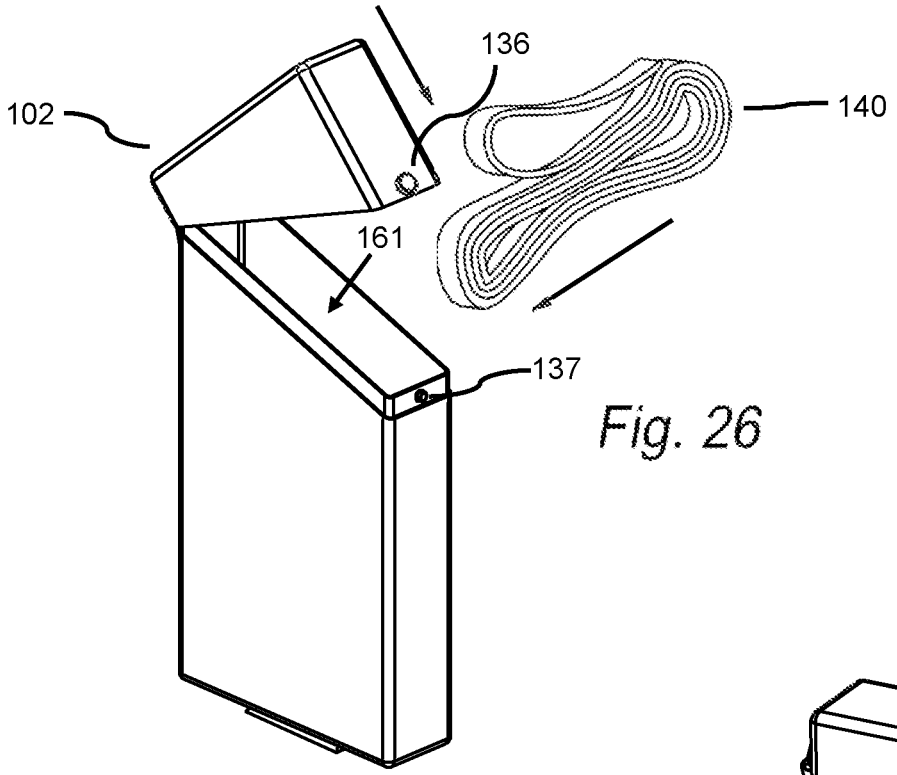
FIG. 26 shows a front perspective view of a storage container, showing the interactions of components thereof and a strap, in accordance with the present technology.

As shown in FIG. 26, in certain embodiments, to utilize the storage container for a strap 100, the lid 102 may be opened and a strap 140 may be placed in a cavity 161 of the hollow main body 101. A shackle holder 120 may be removably coupled with the attachment mechanism 104 by sliding the shackle holder 120 onto the attachment mechanism, as indicated by the arrow. Then the shackle 130 may be placed on the shackle holder 120 (FIG. 27). To access the strap 140 within the hollow main body 101, the lid 102 may be opened and the strap 140 may be removed from the cavity 161.

The hollow main body 101 may vary in size to accommodate differently sized straps 140. In certain embodiments, the hollow main body 101 may be configured to hold a plurality of straps 140. The shackle holder 120 may be configured to be disposed on each of the variable sized hollow main bodies 101. For example, the shackle holder 120 may be removed from the hollow main body 101 and removably attach to a second differently sized hollow main body 101 of a storage container for holding a strap 100. In certain embodiments, the lid 102 may be embossed or otherwise imprinted with a marking 160 that shows a size and/or a configuration of the strap 140 inside the hollow main body.

Figure 29:
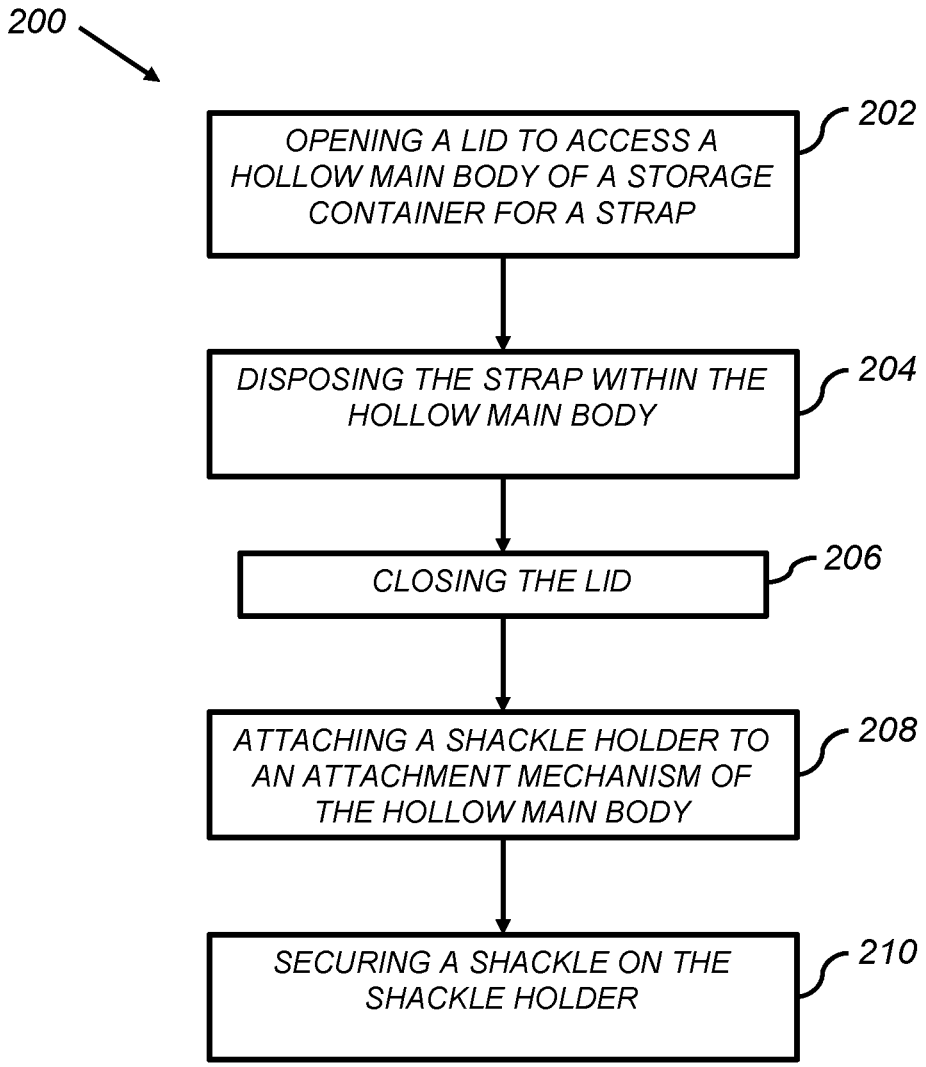
FIG. 29 shows a flowchart of a method of using a storage container, in accordance with the present technology.

Referring to FIG. 29, a method 200 of storing a strap is shown. In step 202, a lid 102 is opened to access a hollow main body 101 of a storage container for storing a strap 100, where the lid 102 is disposed at a first end 103 of the hollow main body 101. In step 204, a strap 140 may be disposed within the hollow main body 101. Then, in step 206, the lid may be closed and in step 208, a shackle holder 120 may be removably attached to an attachment mechanism 104 of the hollow main body 101. The attachment mechanism 104 may be disposed at a second end 105 of the hollow main body 101. Then, in step 210, a shackle bow 131 and a shackle pin 133 may be secured on the shackle holder 120. Opening the lid 102 may comprise tilting the lid 102 via a hinge mechanism 107. Removably attaching the shackle holder 120 to the attachment mechanism 104 may comprise slidably attaching the shackle holder 120 to a sliding dovetail connection of the storage container for storing a strap 100. In certain embodiments, the method 200 may further comprise removing the shackle holder 120 from attachment mechanism 104 of the hollow main body 101 and removably attaching the shackle holder 120 to a second, differently sized storage container for storing a strap 100.

While certain representative embodiments and details have been shown for purposes of illustrating the invention, it will be apparent to those skilled in the art that various changes may be made without departing from the scope of the disclosure, which is further described in the following appended claims.

What is claimed is:

1. A storage container for a strap, comprising:

a hollow main body including a first end and a second end, where the second end of the hollow main body is opposite the first end;

a lid disposed at the first end of the hollow main body;

an attachment mechanism disposed at the second end of the hollow main body on an exterior surface of the second end of the hollow main body, wherein the attachment mechanism comprises a protrusion extending outwardly from the second end of the hollow main body; and a shackle holder configured to removably attach to the protrusion of the attachment mechanism, wherein the shackle holder includes:

a shackle holder body configured to receive a shackle bow and a shackle pin;

a main body side including a notch configured to slidably receive the protrusion of the attachment mechanism; and a shackle side including an aperture and a shackle mouth, the aperture configured to retain a shackle pin and the shackle mouth configured to retain a shackle bow.

2. The storage container for a strap of claim 1, wherein the shackle holder slidably attaches to the protrusion.

3. The storage container for holding a strap of claim 2, wherein the protrusion comprises a sliding dovetail connection such that the shackle holder slidably attaches to the second end of the hollow main body through the sliding dovetail connection.

4. The storage container for holding a strap of claim 1, wherein the lid comprises a hinged lid that attaches to the hollow main body through a hinge, wherein the lid is tilted via the hinge to access the hollow main body.

5. The storage container for holding a strap of claim 4, wherein the hinged lid includes a retaining mechanism.

6. The storage container for holding a strap of claim 4, wherein the retaining mechanism includes one of a friction fit, a clasp, a lock, a male/female attachment, a rubberized T-latch, and combinations thereof.

7. The storage container of claim 4, wherein the hinge comprises a pin and knuckle joint.

8. The storage container for holding a strap of claim 1, wherein the lid comprises a hinged lid that attaches to the hollow main body through a hinge, wherein the lid is tilted via the hinge to access the hollow main body.

9. The storage container of claim 1, wherein the lid includes a window for viewing an interior of the hollow main body.

10. The storage container for a strap of claim 1, wherein an exterior of the hollow main body is textured for stackable layering of additional storage containers to the hollow main body.

11. The storage container for a strap of claim 1, wherein the hinged lid is configured to slidably detach from the second end of the hollow main body.

12. The storage container for a strap of claim 1, further comprising a shackle including a shackle bow and a shackle pin.

13. The storage container for a strap of claim 12, wherein the aperture retains the shackle pin, the shackle bow retains the shackle mouth, the shackle holder thereby securing the shackle.

14. The storage container for a strap of claim 12, further comprising a strap.

15. A kit for protecting a strap, comprising:

a storage container for the strap, the storage container including:

a hollow main body including a first end and a second end, where the second end of the hollow main body is opposite the first end;

a lid disposed at the first end of the body;

a shackle holder removably attached to the second end of the hollow main body on an exterior surface of the second end of the hollow main body, wherein the shackle holder includes:

a shackle holder body configured to receive a shackle bow and a shackle pin;

a main body side including a notch configured to slidably receive the protrusion of the attachment mechanism; and a shackle side including an aperture and a shackle mouth, the aperture configured to retain a shackle pin and the shackle mouth configured to retain a shackle bow;

a shackle including the shackle pin and the shackle bow, the shackle retained on the shackle holder; and a strap disposed within the hollow main body.

16. The kit for protecting a strap of claim 15, wherein the lid comprises a hinged lid that attaches to the hollow main body through a hinge, where the lid is tilted via the hinge to access the hollow main body.

17. A method of storing a strap, comprising:

opening a lid to access a hollow main body of a storage container for storing the strap, wherein the lid is disposed at a first end of the hollow main body;

disposing the strap within the hollow main body;

closing the lid;

removably attaching a shackle holder to an attachment mechanism of the hollow main body, wherein the attachment mechanism is disposed at a second end of the hollow main body on an exterior surface of the second end of the hollow main body; and securing a shackle on the shackle holder.

18. The method of claim 17, wherein opening the lid comprises tilting the lid via a hinge to access the hollow main body.

19. The method of claim 17, wherein removably attaching the shackle holder to the attachment mechanism comprises slidably attaching the shackle holder to a protrusion extending outwardly from the second end of the hollow main body on an exterior surface of the second end of the hollow main body.

20. The method of claim 17, further comprising removing the shackle holder from attachment mechanism of the hollow main body and removably attaching the shackle holder to a second, differently sized storage container.

* * * * *